US005603190A

United States Patent [19]

Sanford

[11] Patent Number: 5,603,190

[45] Date of Patent: Feb. 18, 1997

[54] STORM PANEL AND ATTACHMENT APPARATUS

[76] Inventor: Elizabeth A. Sanford, 1009 Talbury Ct., Brittany Woods, Wilmington, N.C. 28405

[21] Appl. No.: 378,581

[22] Filed: Jan. 26, 1995

[51] Int. Cl.[6] ..... E06B 9/02

[52] U.S. Cl. ..... 52/202; 16/114 R; 49/61; 52/208; 52/476; 52/780; 52/DIG. 12

[58] Field of Search ..... 52/202, 203, 204.591, 52/204.597, 204.62, 208, 476, 483.1, 780, DIG. 12; 49/61, 62, 463, 465, 501; 16/110 R, 114 R, 125, 127

[56] References Cited

U.S. PATENT DOCUMENTS

| | | | |
|---|---|---|---|
| 2,211,391 | 8/1940 | Shockey | 16/114 R X |
| 2,612,308 | 9/1952 | Potts | 16/125 |
| 3,516,470 | 6/1970 | Kurz . | |
| 3,528,196 | 9/1970 | Luke . | |
| 3,745,704 | 7/1973 | Covington | 49/61 X |
| 4,089,143 | 5/1978 | La Pietra | 52/202 X |
| 4,110,870 | 9/1978 | Weihrauch | 16/114 R |
| 4,287,683 | 9/1981 | Louwenaar | 52/202 X |
| 4,333,271 | 6/1982 | De Paolo et al. . | |
| 4,384,436 | 5/1983 | Green . | |
| 4,404,709 | 9/1983 | Janz et al. | 16/114 R X |
| 4,454,691 | 6/1984 | Mitchell | 52/202 |
| 4,562,666 | 1/1986 | Young, III | 49/62 |
| 4,685,261 | 8/1987 | Seaquist . | |
| 4,856,575 | 8/1989 | Wells | 52/208 X |
| 5,228,238 | 7/1993 | Fenkell . | |
| 5,347,775 | 9/1994 | Santos | 52/202 |
| 5,383,315 | 1/1995 | Birs | 52/203 X |
| 5,430,982 | 7/1995 | Bane | 52/202 |

FOREIGN PATENT DOCUMENTS

| | | | |
|---|---|---|---|
| 571572 | 9/1977 | U.S.S.R. | 49/61 |
| 2146377 | 4/1985 | United Kingdom | 52/202 |

*Primary Examiner*—Carl D. Friedman
*Assistant Examiner*—Kevin D. Wilkens

[57] ABSTRACT

A storm panel and attachment apparatus for protecting an exterior window in a structure includes three frame members attached to the structure peripheral to the window. A panel assembly includes a panel member and a panel-mounted connector assembly connected to the panel member. The panel-mounted connector assembly connects the panel assembly to the structure either directly or by way of a frame member. In a first embodiment, the panel-mounted connector assembly includes a panel-attached frame member which includes a first frame portion connected to the panel member and a second frame portion adapted for connection to the structure. U-shaped channels in the frame members are adapted to receive edges of the panel member when the panel member is slid onto the frame members. In a second embodiment, the panel-mounted connector assembly includes a plurality of captive first connector elements distributed at first positions on the panel-mounted connector assembly. Each of the frame members includes a plurality of captive second connector elements distributed at second positions on the frame members. When the first positions are placed in registration with the second positions, the first connector elements can be connected to the second connector elements whereby the panel member is mounted on the frame members. More specifically, the panel member is connected to the frame members which are connected to the structure. In a third embodiment, the panel member includes a removable and replaceable handle.

3 Claims, 5 Drawing Sheets

27
12
11
4
16
30
32
23
32
4
27
12
26
30

16
31
35
32
30
33
37
28
26
17
39
14
12

STORM PANEL AND ATTACHMENT APPARATUS

BACKGROUND OF THE INVENTION

1. Field of the Invention

The present invention relates generally to panels for covering windows during storms and, more particularly, to storm panels that are especially adapted for being removed when the threat of a storm is absent and for being replaced when a storm is anticipated.

2. Description of the Prior Art

Window, especially glass windows, are often in need of protection during storms such as hurricanes when high winds occur. One way of protecting such glass windows in to use plywood to cover the windows. The use of plywood has two significant disadvantages. The plywood is opaque, and light cannot filter through the plywood. In addition, the wood is generally usable for only one storm. For another storm, the previously used plywood is discarded, and new plywood is obtained. It would be desirable to be able to avoid the problems associated with the use of plywood. That is, it would be desirable if storm panels were provided which were translucent, thereby permitting light to filter through into a room. In addition, it would be desirable if storm panels were provided which can be used over and over again for different storm conditions.

Throughout the years, a number of innovations have been developed relating to devices for protecting glass windows during storms such as hurricanes, and the following U.S. Pat. Nos. are representative of some of those innovations: 3,516,470; 3,528,196; 4,333,271; 4,384,436; 4,685,261; and 5,228,238. More specifically, U.S. Pat. No. 3,516,470 discloses a removable storm shutter that has a plurality of relatively small panel units that are connected together in head-to-tail fashion. The use of head-to-tail connection between adjacent panel units requires the panel units to be specially manufactured in a complex way. To avoid the complexities of connecting a plurality of small panel units together in head-to-tail fashion, it would be desirable if single storm panels were provided that were large enough to cover a window without the need to connect small panels together in head-to-tail fashion.

U.S. Pat. No. 3,528,196 discloses a window and hurricane panels for use with the window. The window itself has a plurality of small window units that cooperate together to form a single window. Similarly, each window unit is designed to receive and individual slide-in hurricane panel. Thus, as discussed above, a plurality of small panel units are employed to cover a single window. Moreover, a relatively complex linkage system is used to have the small window units cooperate together to form the single window. When the small hurricane panels are installed adjacent to the small window units, the complex linkage system is used to control the plurality of hurricane panels. To avoid the complexities associated with linkage mechanisms, it would be desirable if storm panels were provided which do not require a complex linkage system for controlling the storm panels.

U.S. Pat. No. 4,333,271 discloses a pair of panels that are used inside a room and serve to protect the interior of the room from both a storm and unauthorized entry. Because the panels are installed inside the room, they do not protect the room window from the storm. Moreover, the room installation may be deemed unaesthetically acceptable. Some people may not want to readily see the support structure for the panels in the room interior all year round. In this respect, it would be desirable if storm panels were provided which were not installed in a room interior.

U.S. Pat. No. 4,384,436 discloses a combination hurricane shutter and security grill. The security grill uses metal bars and other metal structures. Moreover, metal portions of the security grill are used for attaching the combination device over a window structure. There are many windows in a dwelling, especially above-ground windows, where the use of metal bars and other security devices may not be warranted or desired. In this respect, it would be desirable if storm panels were provided which do not include metal bars and other security devices.

U.S. Pat. No. 4,685,261 discloses a storm shutter that employs a removable translucent and shatter resistant storm shutter that is removably secured within upper and lower brackets mounted on a window frame. The lower bracket is adaptable to window sills of varying angles due to an adjustable lower angle member. With this device, borders are attached to edges of the shutter; and screws, which penetrate into the shutter, are used to attach the borders to the shutter. The borders are used to slide in U-shaped channels. To avoid the complexity and effort required for affixing borders to translucent panels, it would be desirable if storm panels were provided which did not include attached border for sliding within channels.

U.S. Pat. No. 5,228,238 discloses a transparent storm shutter that is attached by a hinge structure to outside a window. The transparent shutter is moved around the hinge and propped up by a brace to allow air to enter through an open window. Even though propped open, fully unimpeded ventilation through an open window is not possible as long as the transparent shutter is present. Yet, the shutter is not easily removed and replaced, and the hinge mechanism is substantially always present. To provide more adequate ventilation, and to permit a shutter to be easily removed and replaced, it would be desirable if storm panels were provided which did not include hinged connections for connecting the storm panels to structures surrounding a window.

Still other features would be desirable in a storm panel and attachment apparatus. For example, when a removable and replaceable storm panel is installed to cover a window, fasteners, such as screws must be found and used to install the removable and replaceable panels. To alleviate the problem of searching for and finding suitable fasteners each time a removable and replaceable storm panel is installed over a window, it would be desirable if storm panels were provided with dedicated fasteners that remained with the storm panel, even when the storm panel is removed from the window.

Often, removable and replaceable storm panels are slid into and out of retention channels. To slide the panels properly, the panels are generally pushed by their edges. Often, however, fingers are injured or stuffed when panels are pushed by their edges. Moreover, if it necessary to pull on a panel to remove it, then the panel must somehow be pinched in order to permit the panel to be pulled. Pinching of moderate intensity may not be sufficient for proper pulling on the storm panel. Moreover, it may be very difficult to exert a pinching action on the storm panel that is sufficiently strong to provide an adequate pulling action on the panel. If a pinching action is too strong, the panel may be damaged. In this respect, it would be desirable if storm panels were provided which do not require a pinching action on a panel edge in order to pull on the panel.

Thus, while the foregoing body of prior art indicates it to be well known to use translucent panels for protecting windows during storms, the prior art described above does not teach or suggest a storm panel and attachment apparatus which has the following combination of desirable features: (1) provides storm panels are translucent, thereby permitting light to filter through into a room; (2) provides storm panels which can be used over and over again for different storm conditions; (3) provides single storm panels that are large enough to cover a window without the need to connect small panels together in head-to-tail fashion; (4) does not require a complex linkage system for controlling the storm panels; (5) is not installed in a room interior; (6) does not include metal bars and other security devices; (7) does not include attached borders for sliding within channels; (8) does not include hinged connections for connecting the storm panels to structures surrounding a window; (9) is provided with dedicated fasteners that remain with the storm panel, even when the storm panel is removed from the window; and (10) do not require a pinching action on a panel edge in order to pull on the panel. The foregoing desired characteristics are provided by the unique storm panel and attachment apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a storm panel and attachment apparatus for protecting an exterior window in a structure and which includes at least two frame members attached to the structure peripheral to the window. A panel assembly includes a panel member and a panel-mounted connector assembly connected to the panel member. The panel-mounted connector assembly connects the panel assembly to the structure. In a first embodiment, the panel-mounted connector assembly includes a panel-attached frame member which includes a first frame portion connected to the panel member and a second frame portion adapted for connection to the structure. The second frame portion of the panel-attached frame member includes apertures adapted for receiving fasteners for attaching the panel-attached frame member to the structure.

In the first embodiment, the frame members include U-shaped channels adapted to receive edges of the panel member when the panel member is slid onto the frame members. The frame members include flange portions which include apertures adapted for receiving fasteners for attaching the frame members to the structure.

In a second embodiment, the panel-mounted connector assembly includes a plurality of first connector elements distributed at first positions on the panel-mounted connector assembly. Each of the frame members includes a plurality of second connector elements distributed at second positions on the frame members. With the second embodiment, the first positions are placed in registration with the second positions. Moreover, when the panel member is mounted on the frame members, the first connector elements are adapted to be connected to the second connector elements as a result of the fact that the first positions are placed in registration with the second positions. More specifically, the panel member is connected to the frame members which is connected to the structure. The panel member includes apertures through which the first connector elements extend, and the frame members include apertures through which the first connector elements for connecting with the second connector elements are connected to the frame members. The first connector elements may include screws, and the second connector elements may include nuts.

In a third embodiment, the panel member includes a removable and replaceable handle. The panel member includes two handle-receiver apertures, and the handle includes two free ends adapted to be placed in registration with the handle-receiver apertures for connecting the handle to the panel member. The free ends of the handle may be S-shaped and include far end portions, intermediate portions positioned at right angles to the far end portions, and near end portions positioned at right angles to the intermediate portions and parallel to the far end portions.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved storm panel and attachment apparatus which has all of the advantages of the prior art and none of the disadvantages.

It is another object of the present invention to provide a new and improved storm panel and attachment apparatus which may be easily and efficiently manufactured and marketed.

It is a further object of the present invention to provide a new and improved storm panel and attachment apparatus which is of durable and reliable construction.

An even further object of the present invention is to provide a new and improved storm panel and attachment apparatus which is susceptible of a low cost of manufacture with regard to both materials and labor, and which accordingly is then susceptible of low prices of sale to the consuming public, thereby making such storm panel and attachment apparatus available to the buying public.

Still yet a further object of the present invention is to provide a new and improved storm panel and attachment apparatus which provides storm panels are translucent, thereby permitting light to filter through into a room.

Still another object of the present invention is to provide a new and improved storm panel and attachment apparatus that provides storm panels which can be used over and over again for different storm conditions.

Yet another object of the present invention is to provide a new and improved storm panel and attachment apparatus which provides single storm panels that are large enough to cover a window without the need to connect small panels together in head-to-tail fashion.

Even another object of the present invention is to provide a new and improved storm panel and attachment apparatus that does not require a complex linkage system for controlling the storm panels.

Still a further object of the present invention is to provide a new and improved storm panel and attachment apparatus which is not installed in a room interior.

Yet another object of the present invention is to provide a new and improved storm panel and attachment apparatus that does not include metal bars and other security devices.

Still another object of the present invention is to provide a new and improved storm panel and attachment apparatus which does not include attached borders for sliding within channels.

Yet another object of the present invention is to provide a new and improved storm panel and attachment apparatus that does not include hinged connections for connecting the storm panels to structures surrounding a window.

An even further object of the present invention is to provide a new and improved storm panel and attachment apparatus that includes dedicated fasteners that remain with the storm panel, even when the storm panel is removed from the window.

Yet another object of the present invention is to provide a new and improved storm panel and attachment apparatus which does not require a pinching action on a panel edge in order to pull on the panel.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
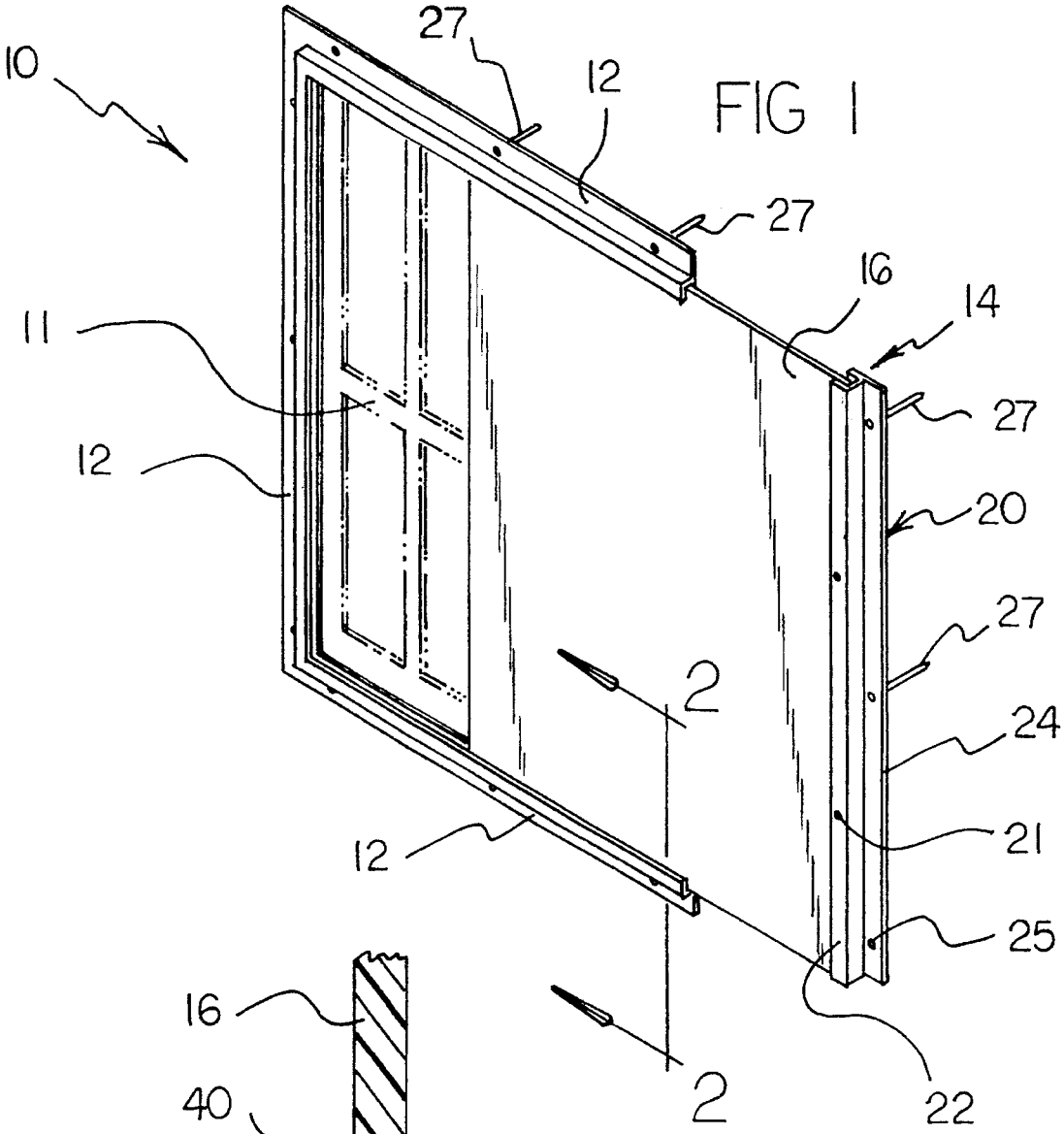
FIG. 1 is a perspective view showing a first preferred embodiment of the storm panel and attachment apparatus of the invention.

With reference to the drawings, a new and improved storm panel and attachment apparatus embodying the principles and concepts of the present invention will be described.

Turning to the drawing figures, there are shown exemplary embodiments of the storm panel and attachment apparatus of the invention generally designated by reference numeral 10. The storm panel and attachment apparatus 10 is used for protecting an exterior window 11 in a structure 15, such as during storm conditions. The storm panel and attachment apparatus 10 includes at least two frame members 12 attached to the structure 15 peripheral to the window 11. A panel assembly 14 includes a panel member 16 and a panel-mounted connector assembly connected to the panel member 16. The panel-mounted connector assembly connects the panel assembly 14 to the structure 15, either directly to the structure 15 or by means of the frame members 12.

Figure 2:
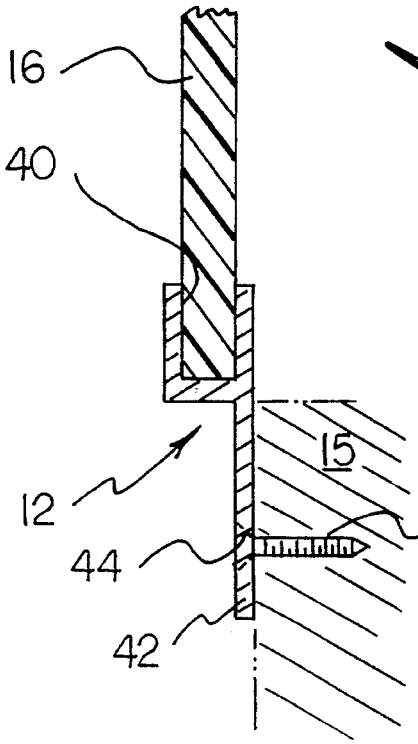
FIG. 2 is a cross-sectional view of the embodiment of the storm panel and attachment apparatus shown in FIG. 1 taken along line 2—2 of FIG. 1.

In a first embodiment of the invention shown in FIGS. 1–2, the panel-mounted connector assembly includes a panel-attached frame member 20 which includes a first frame portion 22 connected to the panel member 16 and a second frame portion 24 adapted for connection to the structure 15. The panel-attached frame member 20 can be attached to the panel member 16 using conventional fasteners such as screws 21. The second frame portion 24 of the panel-attached frame member 20 includes apertures 25 adapted for receiving fasteners 27 for attaching the panel-attached frame member 20 to the structure 15.

In the first embodiment, the frame members 12 include U-shaped channels 40 adapted to receive edges of the panel member 15 when the panel member 15 is slid onto the frame members 12. The frame members 12 include flange portions 42 which include apertures 44 adapted for receiving fasteners 27 for attaching the frame members 12 to the structure 15.

In operation of the first embodiment of the invention, three frame members 12 are connected to the structure 15 in a manner that flames the window 11 on three sides. Fasteners 27, such as screws 27, are placed in registration with the apertures 44 for connecting the frame members 12 to the structure 15. Free edges of the panel member 16 slide against the channels 40 of the frame members 12 as the panel assembly 14 is slid into position over the window 11. Once the panel member 15 is in position in the frame members 12, the panel-attached frame member 20 is attached to the structure 15 by using fasteners 27 through the apertures 25. To remove the first embodiment of the invention from the structure 15, the fasteners 27 are detached from the structure 15, and the panel assembly 14 is slid out from the frame members 12.

Figure 3:
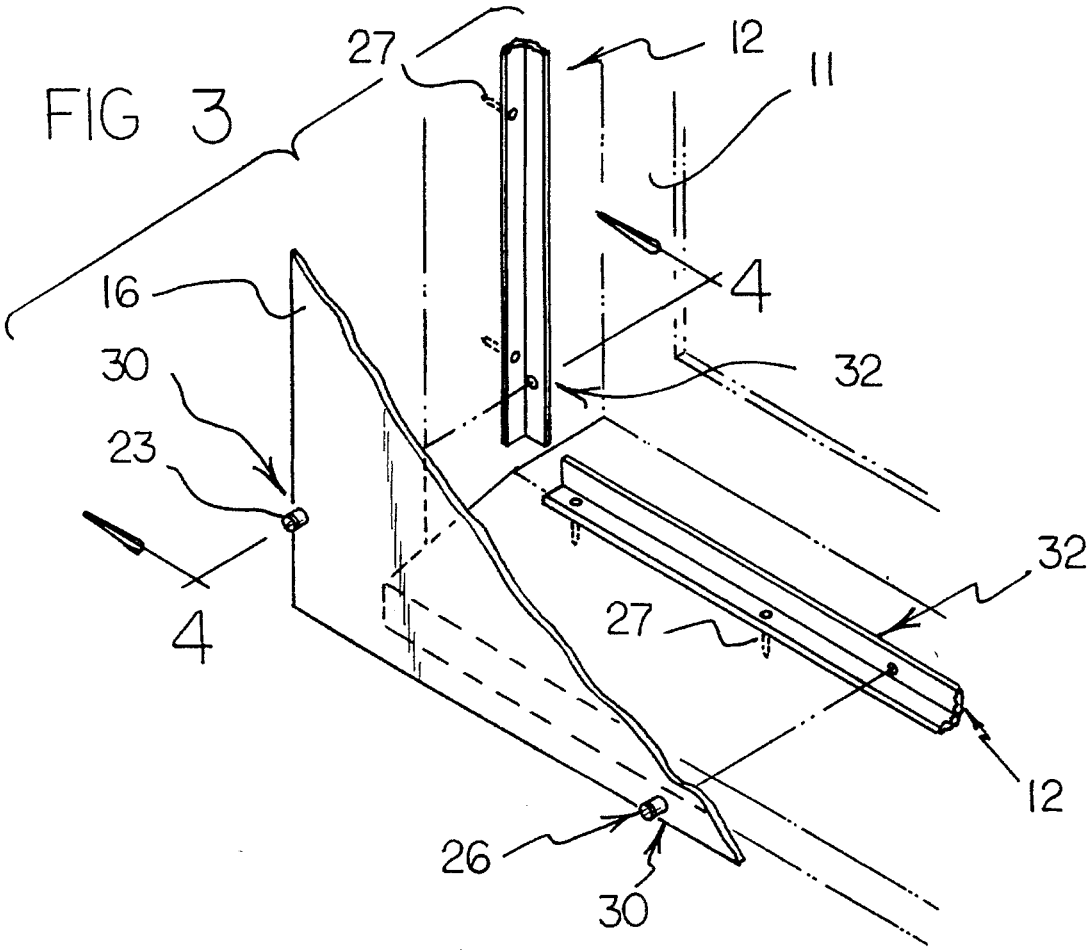
FIG. 3 is a partially exploded perspective view of a second embodiment of the storm panel and attachment apparatus of the invention.
Figure 5:
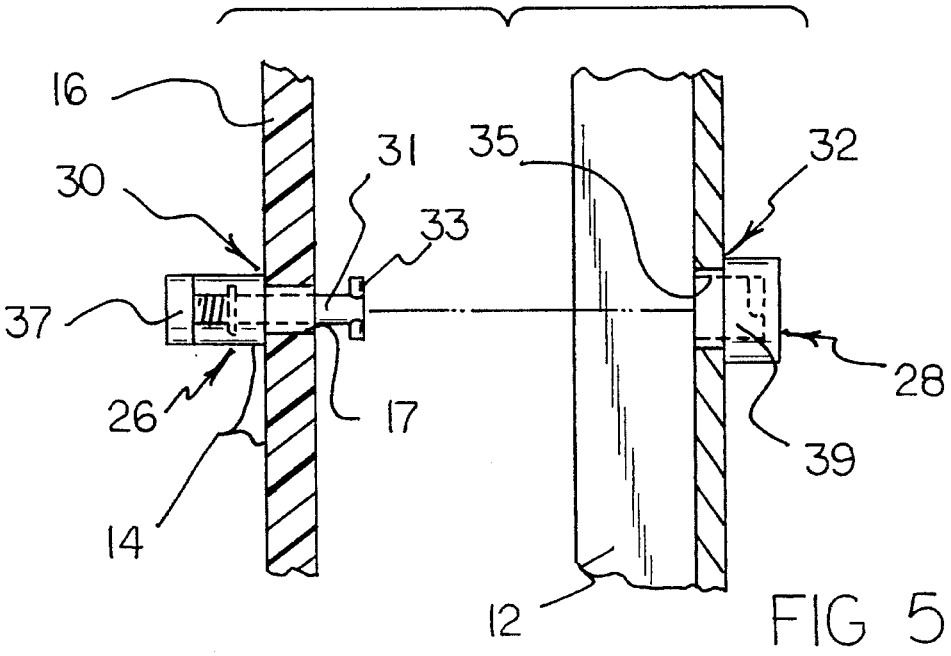
FIG. 5 is a cross-sectional view of a variation of the embodiment of the invention shown in FIG. 4.
Figure 4:
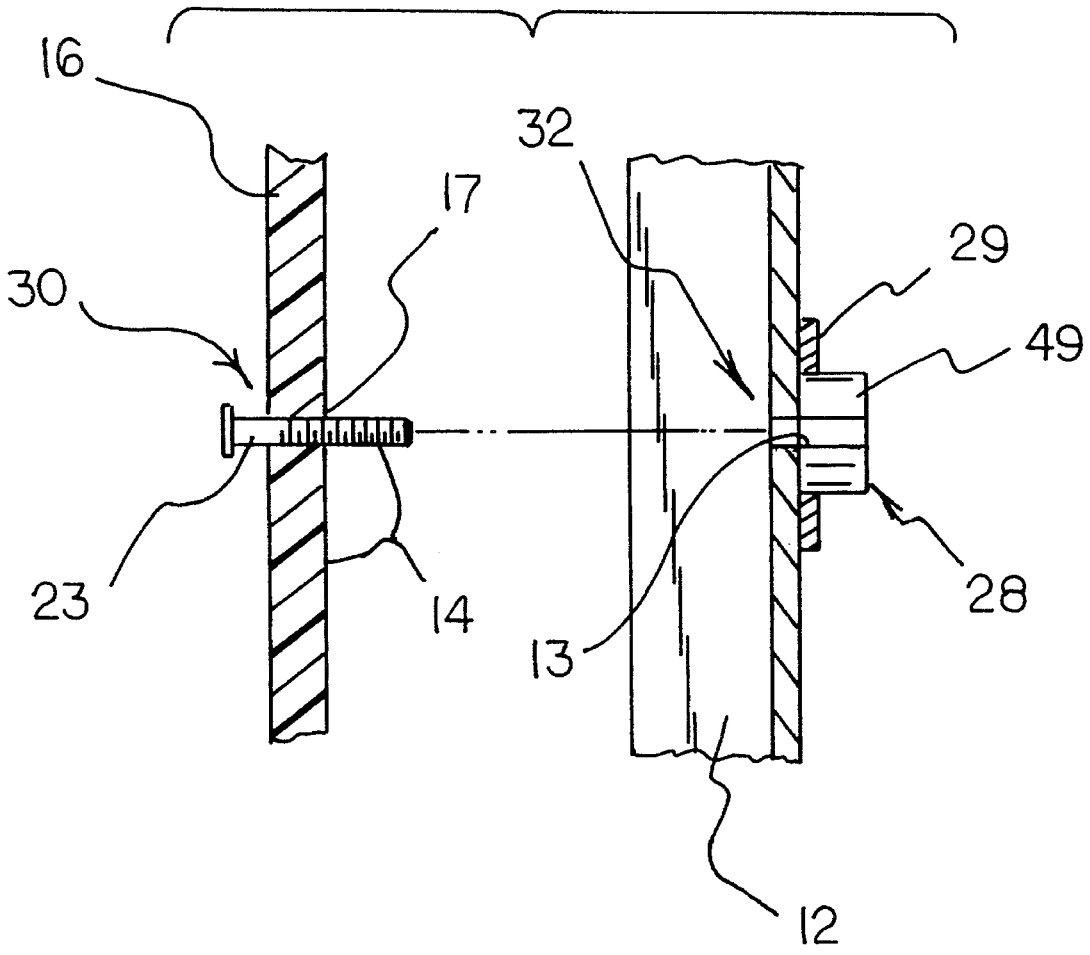
FIG. 4 is an enlarged cross-sectional view of the embodiment of the invention shown in FIG. 3 taken along line 4—4 of FIG. 3.
Figure 6:
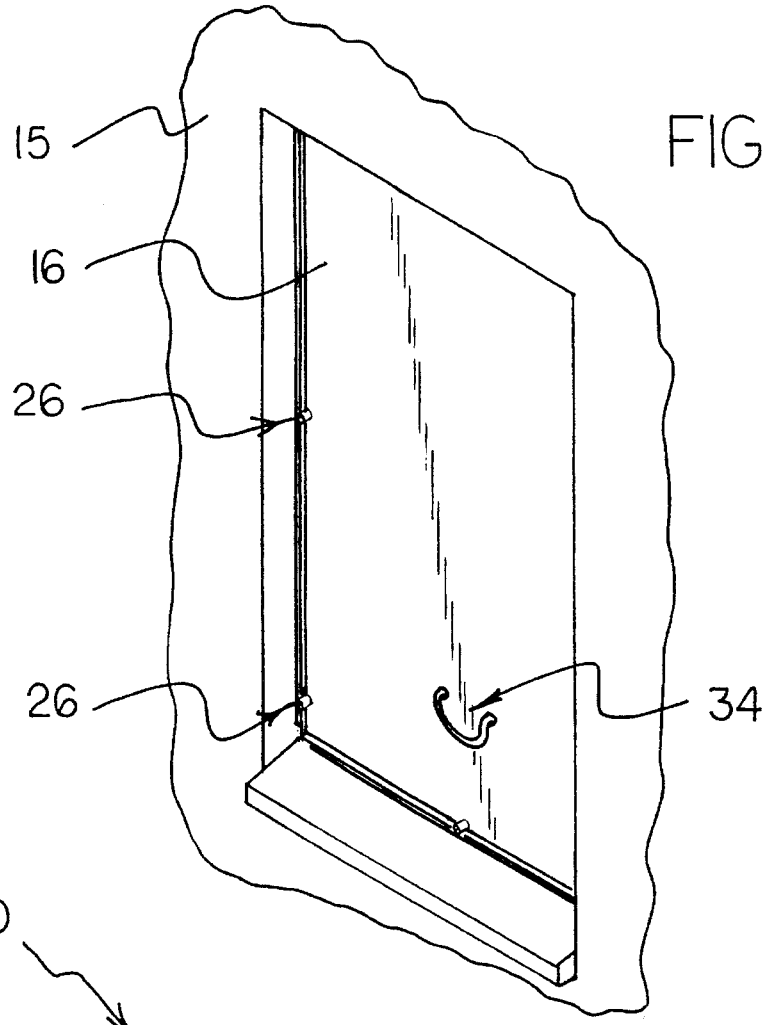
FIG. 6 is a perspective view of a third embodiment of the storm panel and attachment apparatus of the invention.

Turning to FIGS. 3–5, a second embodiment of the invention is shown. Reference numerals are shown that correspond to like reference numerals that designate like elements shown in the other figures. In the second embodiment, the panel-mounted connector assembly includes a plurality of first connector elements 26 distributed at first positions 30 on the panel-mounted connector assembly. Each of the frame members 12 includes a plurality of second connector elements 28 distributed at second positions 32 on the frame members 12. With the second embodiment, the first positions 30 are placed in registration with the second positions 32. Moreover, when the panel member 16 is mounted on the frame members 12, the first connector elements 26 are adapted to be connected to the second connector elements 28 as a result of the fact that the first positions 30 are placed in registration with the second positions 32. More specifically, the panel member 16 is connected to the frame members 12 which is connected to the structure 15. The panel member 16 includes apertures 17 through which the first connector elements 26 extend, and the frame members 12 include apertures 13 through which the first connector elements 26 for connecting with the second connector elements 28 are connected to the frame members 12.

As shown in FIGS. 3 and 4, the first connector elements 26 include screws 23, and the second connector elements 28 include nuts 49. Tabs 29 are used to secure the nuts 49 to the frame members 12. In essence, the screws 23 attached to the panel assembly 14 are captive connectors on the panel assembly 14. Similarly, the nuts 49 attached to the frame members 12 are captive connectors on the frame members 12.

Other suitable captive first connector elements 26 and captive second connector elements 28 can also be employed. For example, the first connector elements 26 can be comprised of screws 23, and the second connector elements 28 can be comprised of complementary threaded apertures in the frame members 12.

As another example of captive connectors, as shown in FIG. 5, each of the first connector elements 26 can be comprised of a housing 31 with a threaded interior along with a T-shaped key-like extension 33 extending longitudinally out from the outside of the housing 31, and each of the second connector elements 28 can includes a keyway 35 in a frame member 12 for receiving the key-like extension 33 from the first connector element 26. Once the key-like extension 33 passes through the keyway 35, the extension is rotated approximately 90 degrees to prevent the key-like extension from passing back through the keyway 35. Then, a screw 37 is turned into the threaded interior of the housing 31 to pull the rotated key-like extension 33 against the backside of a seat element 39 contacted by the key-like extension 33. The seat element 39 is connected to the corresponding frame member 12. Once the seat element 39 is contacted by the rotated key-like extension 33, further turning of the screw 37 in the housing 31 causes the panel member 16 to be clamped between the housing 31 and the key-like extension 33.

Figure 7:
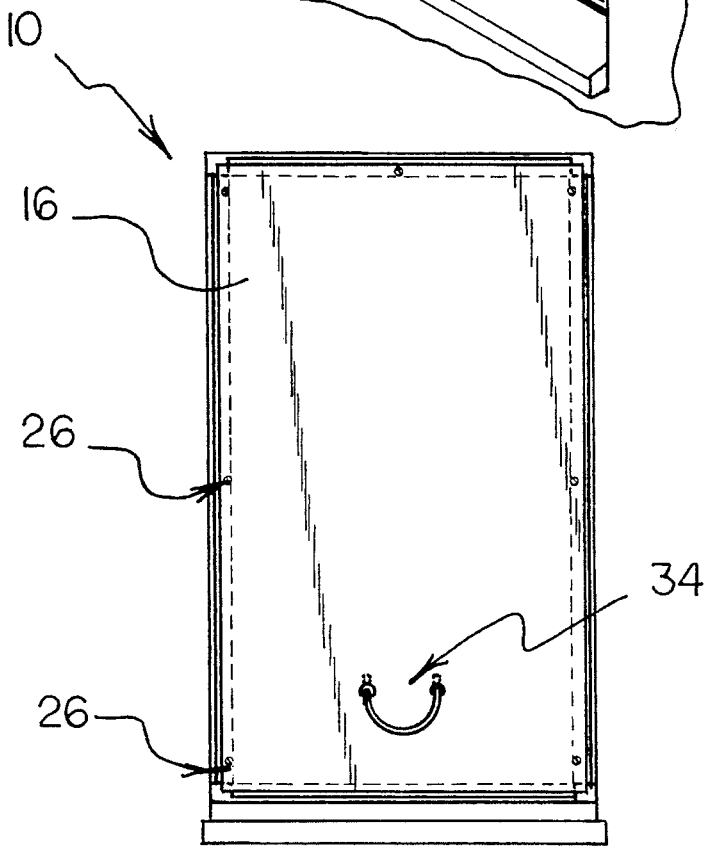
FIG. 7 is a front view of the embodiment of the invention shown in FIG. 6.
Figure 8:
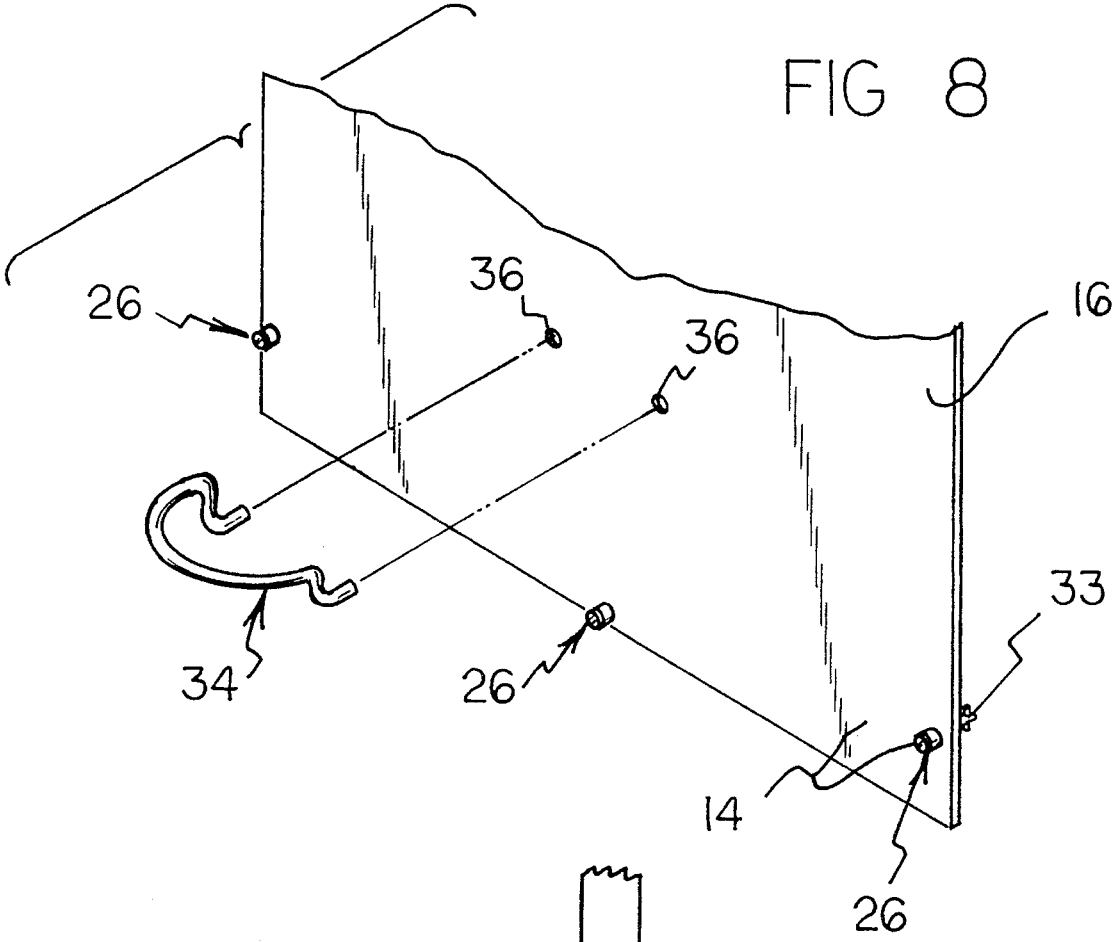
FIG. 8 an enlarged, partially exploded perspective view of a portion of the embodiment of the invention shown in FIGS. 6 and 7.
Figure 9:
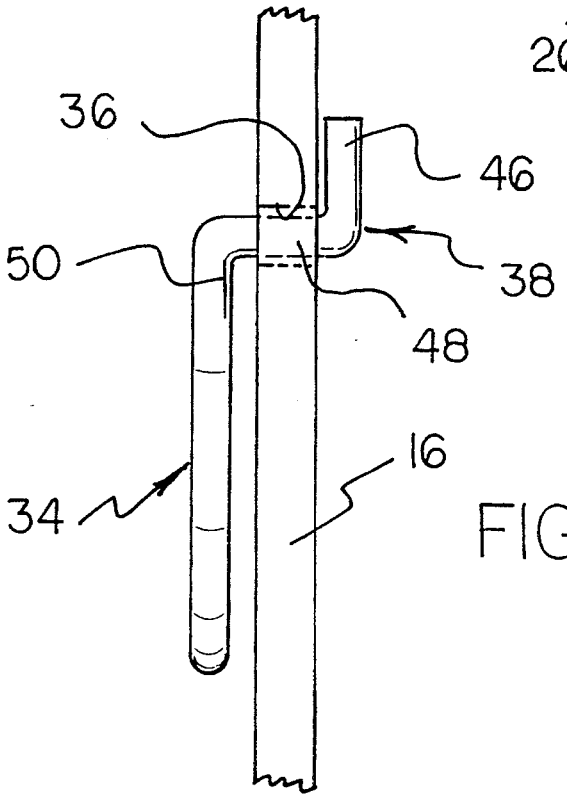
FIG. 9 is an enlarged edge view of a portion of the embodiment of the invention shown in FIGS. 6–8.

Turning to FIGS. 7–8, a third embodiment of the invention is shown. Reference numerals are shown that correspond to like reference numerals that designate like elements shown in the other figures. Generally, the panel member 16 is connected to the frame members 12 using captive connectors, such as shown in FIGS. 3–5 above. In addition, the panel member 16 includes a removable and replaceable handle 34. The panel member 16 includes two handle-receiver apertures 36, and the handle 34 includes two free ends 38 adapted to be placed in registration with the handle-receiver apertures 36 for connecting the handle 34 to the panel member 16.

The free ends 38 of the handle 34 are S-shaped and includes far end portions 46, intermediate portions 48 positioned at right angles to the far end portions 46, and near end portions 50 positioned at right angles to the intermediate portions 48 and parallel to the far end portions 46. In installing the handle 34 onto the panel member 16, the far end portions 46 are first placed into the handle-receiver apertures 36 and pushed into the handle-receiver apertures 36 until the intermediate portions 48 bump up against the panel member 16. Then, the handle 34 is rotated ninety degrees to permit the intermediate portions 48 to enter the handle-receiver apertures 36. When this is done, the near end portions 50 of the handle 34 are parallel to the front side of the panel member 16, and the far end portions 46 are parallel to the rear side of the panel member 16. In this orientation, the far end portions 46 prevent the handle 34 from separating from the panel member 16. To remove the handle 34 from the panel member 16, the above-described steps are carried out in reverse.

The components of the storm panel and attachment apparatus of the invention can be made from inexpensive and durable metal and plastic materials. Preferably, the panel member 16 is made from a quarter-inch fiberglass panel.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved storm panel and attachment apparatus that is low in cost, relatively simple in design and operation, and which may advantageously be used to permit light to filter through the panel into a room. With the invention, a storm panel and attachment apparatus provides storm panels which can be used over and over again for different storm conditions. With the invention, a storm panel and attachment apparatus provides single storm panels that are large enough to cover a window without the need to connect small panels together in head-to-tail fashion. With the invention, a storm panel and attachment apparatus is provided which does not require a complex linkage system for controlling the storm panels. With the invention, a storm panel and attachment apparatus is provided which is not installed in a room interior. With the invention, a storm panel and attachment apparatus is provided which does not include metal bars and other security devices. With the invention, a storm panel and attachment apparatus is provided which does not include attached borders for sliding within channels. With the invention, a storm panel and attachment apparatus is provided which does not include hinged connections for connecting the storm panels to structures surrounding a window. With the invention, a storm panel and attachment apparatus is provided which is provided with dedicated fasteners that remain with the storm panel, even when the storm panel is removed from the window. With the invention, a storm panel and attachment apparatus is provided which do not require a pinching action on a panel edge in order to pull on the panel.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A storm panel and attachment apparatus for protecting an exterior window in a structure, comprising:

at least two frame members attached to the structure peripheral to the window, wherein said frame members include U-shaped channels adapted to receive edges of said panel member when said panel member is slid onto said frame members, wherein said frame members include flange portions which include apertures adapted for receiving fasteners for attaching said frame members to the structure, and a panel assembly which includes a panel member and a one-piece panel-mounted connector assembly, connected to said panel member, for connecting said panel assembly to the structure, wherein said one-piece panel-mounted connector assembly includes a panel-attached frame member which includes a first frame portion connected to said panel member and a second frame portion adapted for connection to the structure, wherein said second frame portion of said panel-attached frame member includes apertures adapted for receiving fasteners for attaching said panel-attached frame member to the structure whereby said frame members and said panel-mounted connector assembly support said storm panel about the periphery of the window when the panel is slid onto said frame members.

2. The apparatus of claim 1 wherein said panel member further includes a removable and replaceable handle, and wherein said panel member includes two handle-receiver apertures, and said handle includes two free ends adapted to be placed in registration with said handle-receiver apertures for connecting said handle to said panel member, wherein said free ends of said handle are S-shaped and include far end portions, intermediate portions positioned at right angles to said far end portions, and near end portions positioned at right angles to said intermediate portions and parallel to said far end portions.

3. The apparatus of claim 1 wherein said panel member is made from fiberglass.

* * * * *